US010145201B2

(12) United States Patent
Javed et al.

(10) Patent No.: US 10,145,201 B2
(45) Date of Patent: Dec. 4, 2018

(54) RETRIEVABLE CEMENT BUSHING SYSTEM AND METHODOLOGY

(71) Applicant: Schlumberger Technology Corporation, Sugar Land, TX (US)

(72) Inventors: Asif Javed, Spring, TX (US); James Hall, Spring, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/306,060

(22) PCT Filed: Apr. 24, 2014

(86) PCT No.: PCT/US2014/035317
§ 371 (c)(1),
(2) Date: Oct. 21, 2016

(87) PCT Pub. No.: WO2015/163891
PCT Pub. Date: Oct. 29, 2015

(65) Prior Publication Data

US 2017/0044862 A1 Feb. 16, 2017

(51) Int. Cl.

| | |
|---|---|
| ***E21B 33/128*** | (2006.01) |
| ***E21B 23/06*** | (2006.01) |
| ***E21B 33/12*** | (2006.01) |
| ***E21B 23/02*** | (2006.01) |
| ***E21B 33/14*** | (2006.01) |
| ***E21B 43/10*** | (2006.01) |

(52) U.S. Cl.
CPC ..... *E21B 33/128* (2013.01); *E21B 23/02* (2013.01); *E21B 23/06* (2013.01); *E21B 33/12* (2013.01); *E21B 33/14* (2013.01); *E21B 43/10* (2013.01)

(58) Field of Classification Search
CPC ..... E21B 33/128; E21B 23/06; E21B 33/14
USPC ..... 166/285
See application file for complete search history.

(56) References Cited

U.S. PATENT DOCUMENTS 4,281,711 A 8/1981 Braddick et al.
4,562,889 A 1/1986 Braddick
(Continued)

OTHER PUBLICATIONS

PCT/US2013/026992 International Search Report and Written Opinion, dated Jun. 4, 2013, 13 pgs.
(Continued)

*Primary Examiner* — Zakiya W Bates
*Assistant Examiner* — Ashish K Varma

(57) ABSTRACT

A technique facilitates pressure containment with a retrievable cement bushing. The retrievable cement bushing comprises a body having an internal longitudinal passage. Additionally, the retrievable cement bushing comprises an engagement lug which cooperates with a sleeve. The engagement lug is mounted on the body and is movable to a radially outward position for engagement with a corresponding portion of a surrounding wall, e.g an internal packer wall. The sleeve is sized to receive a slick joint therethrough and is movable to a radially inward position relative to the engagement lug so as to hold the engagement lug in the radially outward position. The sleeve protects the slick joint from inwardly directed loading via the engagement lug when the retrievable cement bushing is subjected to differential pressures.

9 Claims, 4 Drawing Sheets

(56) References Cited

U.S. PATENT DOCUMENTS

| | | | | |
|---|---|---|---|---|
| 4,690,220 | A | 9/1987 | Braddick | |
| 5,472,055 | A | 12/1995 | Simson et al. | |
| 5,884,702 | A | 3/1999 | Yokley et al. | |
| 6,009,943 | A | 1/2000 | Yokley et al. | |
| 6,378,610 | B2 | 4/2002 | Rayssiguier et al. | |
| 6,695,060 | B1 | 2/2004 | Guidry et al. | |
| 6,739,398 | B1 | 5/2004 | Yokley et al. | |
| 7,373,988 | B2 | 5/2008 | Campbell et al. | |
| 7,581,596 | B2 * | 9/2009 | Reimert | E21B 23/04 166/318 |
| 7,686,090 | B2 | 3/2010 | Reimert et al. | |
| 9,062,520 | B2 | 6/2015 | Ingraham et al. | |
| 2007/0251704 | A1 | 11/2007 | Reimert et al. | |
| 2011/0247832 | A1 | 10/2011 | Harris | |
| 2013/0081817 | A1 * | 4/2013 | Norrid | E21B 34/102 166/305.1 |
| 2013/0248180 | A1 * | 9/2013 | Ingraham | E21B 33/12 166/285 |

OTHER PUBLICATIONS

PCT/US2014/035317 International Search Report and Written Opinion, dated Jan. 26, 2015, 13 pgs.

Extended European Search Report for corresponding European Application Serial. No. 14889953.7, dated Apr. 10, 2017, 6 pp.

* cited by examiner

RETRIEVABLE CEMENT BUSHING SYSTEM AND METHODOLOGY

BACKGROUND

Hydrocarbon fluids such as oil and natural gas are obtained from a subterranean geologic formation, referred to as a reservoir. The hydrocarbon fluids may be obtained by drilling a well that penetrates the hydrocarbon-bearing formation. Once a wellbore is drilled, various forms of well completion components may be installed to provide control and to enhance the efficiency of producing the various fluids from the reservoir. In some applications, liners or casing may be deployed downhole and cemented into place. A tool string may be deployed down through the liners to perform a desired service operation, such as a cementing operation. The tool string may comprise a retrievable cementing bushing which provides a temporary seal for pressure containment. The pressure containment is helpful in performing certain actions, e.g. setting a hydraulic liner hanger and facilitating the cementing operation by preventing cement from backing up through an interior of the liner hanger.

SUMMARY

In general, a system and methodology are provided for pressure containment with a retrievable cement bushing. The retrievable cement bushing comprises a body having an internal longitudinal passage. The retrievable cement bushing further comprises an engagement lug which cooperates with a sleeve. The engagement lug is mounted on the body and is movable to a radially outward position for engagement with a corresponding portion of a surrounding wall, e.g an internal packer wall. The sleeve is sized to receive a slick joint and is movable to a radially inward position relative to the engagement lug so as to hold the engagement lug in the radially outward position. The sleeve protects the slick joint from inwardly directed loading via the engagement lug when the retrievable cement bushing is subjected to differential pressures.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
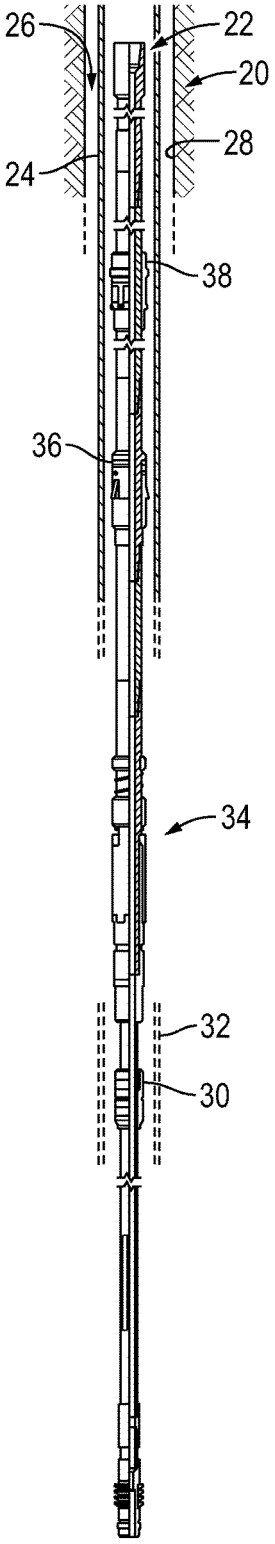
FIG. 1 is an illustration of an example of a well system having a tool string with a retrievable cement bushing, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology for pressure containment in a well via a retrievable cement bushing. The retrievable cement bushing comprises a body having an internal longitudinal passage. Seals may be used to form a sealing engagement with a surrounding wall of a downhole tubular system. The retrievable cement bushing further comprises an engagement lug which cooperates with a sleeve. In some applications, a plurality of the engagement lugs is arranged to provide engagement lugs spaced circumferentially around the body.

The engagement lug (or lugs) is mounted on the body and is movable to a radially outward position for engagement with a corresponding portion of the surrounding wall, e.g a packer body wall. The sleeve is sized to receive a slick joint therethrough and is movable to a radially inward position relative to the engagement lug so as to hold the engagement lug in the radially outward position engaging the surrounding wall. The sleeve protects the slick joint from inwardly directed loading via the engagement lug when the retrievable cement bushing is subjected to differential pressures.

The retrievable cement bushing may be used in a variety of applications. For example, the retrievable cement bushing may be used in a liner hanger running string to provide a temporary seal for pressure containment. The pressure containment allows a hydraulic liner hanger to be set before being disengaged and then retrieved to the surface after desired liner hanger operations have been carried out.

As described in greater detail below, the retrievable cement bushing comprises a sleeve disposed at a radially inward position beneath the engagement lug or lugs while the engagement lug or lugs are engaged with a surrounding wall. The sleeve is positioned to block the engagement lug or lugs from acting against a slick joint during movement of the slick joint through an internal passage of the retrievable cement bushing. In other words, the sleeve absorbs the loading of the engagement lugs due to differential pressures acting on the retrievable cement bushing instead of allowing the engagement lugs to establish loads against the slick joint.

The sleeve not only protects the slick joint from radially inward directed loads but also protects against premature release of the engagement lugs during axial movement of the slick joint through the retrievable cement bushing. With the sleeve in place beneath the engagement lugs, friction is not able to develop between the engagement lugs and the axially moving slick joint in a manner that could otherwise cause release of the engagement lugs. The construction of the retrievable cement bushing also allows the bushing to be locked in its profile in a surrounding wall, e.g. a surrounding packer wall. Depending on the application, the slick joint or another suitable tool may be used to actuate the retrievable cement bushing into the profile of the surrounding wall by causing radial expansion of the engagement lugs into the profile. The slick joint also may be used to lock the sleeve at the radially inward position beneath the engagement lugs of the retrievable cement bushing so that premature release does not occur.

The retrievable cement bushing is useful in many applications were pressure integrity is desired. In cementing applications, for example, a liner hanger string is employed and comprises a running string used to run and set a liner hanger and a liner top packer. The running string is disconnected after the hanger is set. Following completion of a cementing operation, the running string is used to set the liner top packer and then is pulled out to the surface. In this type of application, the retrievable cement bushing is located at the interface of the running string and the packer (sometimes the hanger) to provide a seal barrier. If there is no seal at this interface, pumped fluids in the drill pipe are circulated up the annulus from the running string rather than being circulated down to the casing shoe for proper cementing of the liner string. The retrievable cement bushing also enables pressure testing of the packer from the annulus.

While running downhole into the well in at least some applications, the retrievable cement bushing remains latched in its profile in a surrounding wall, e.g. in the surrounding wall of a packer, and provides a seal between itself and the surrounding wall. The retrievable cement bushing also may comprise internal seals which provide a seal between the retrievable cement bushing and a slick joint of a running string as the slick joint passes through the inside of the retrievable cement bushing. Thus, the retrievable cement bushing is able to provide external and internal seals while also taking the loading imparted due to pressures acting on the retrievable cement bushing. The retrievable cement bushing comprises at least one engagement lug which enables the retrievable cement bushing to be latched into the packer profile (or other suitable profile). The at least one engagement lug allows the retrievable cement bushing to be retrieved with minimal force applied during pulling of the running string out of hole.

Referring generally to FIG. 1, an example of a well system 20 is illustrated. The well system 20 comprises a tool string 22 deployed in a surrounding tubular system 24 positioned within a wellbore 26. The wellbore 26 may be an open wellbore or a cased wellbore lined by a casing 28. In some embodiments, the surrounding tubular system 24 may comprise a liner system having a variety of components, including packers and other completion related components. Similarly, tool string 22 may comprise a variety of components, including a retrievable cement bushing 30. The retrievable cement bushing 30 may be releasably latched into a surrounding wall 32 of a component, e.g. packer, of tubular system 24 during running downhole into wellbore 26.

Depending on the application, tool string 22 also may comprise other types of components. Examples of such components include a hydraulic running tool 34, an internal packer 36, and a junk bonnet 38. The various tool string components may be connected together by a variety of subs and/or other tubular components. The selection of tool string components can vary depending on the parameters of a given well servicing application.

Figure 2:
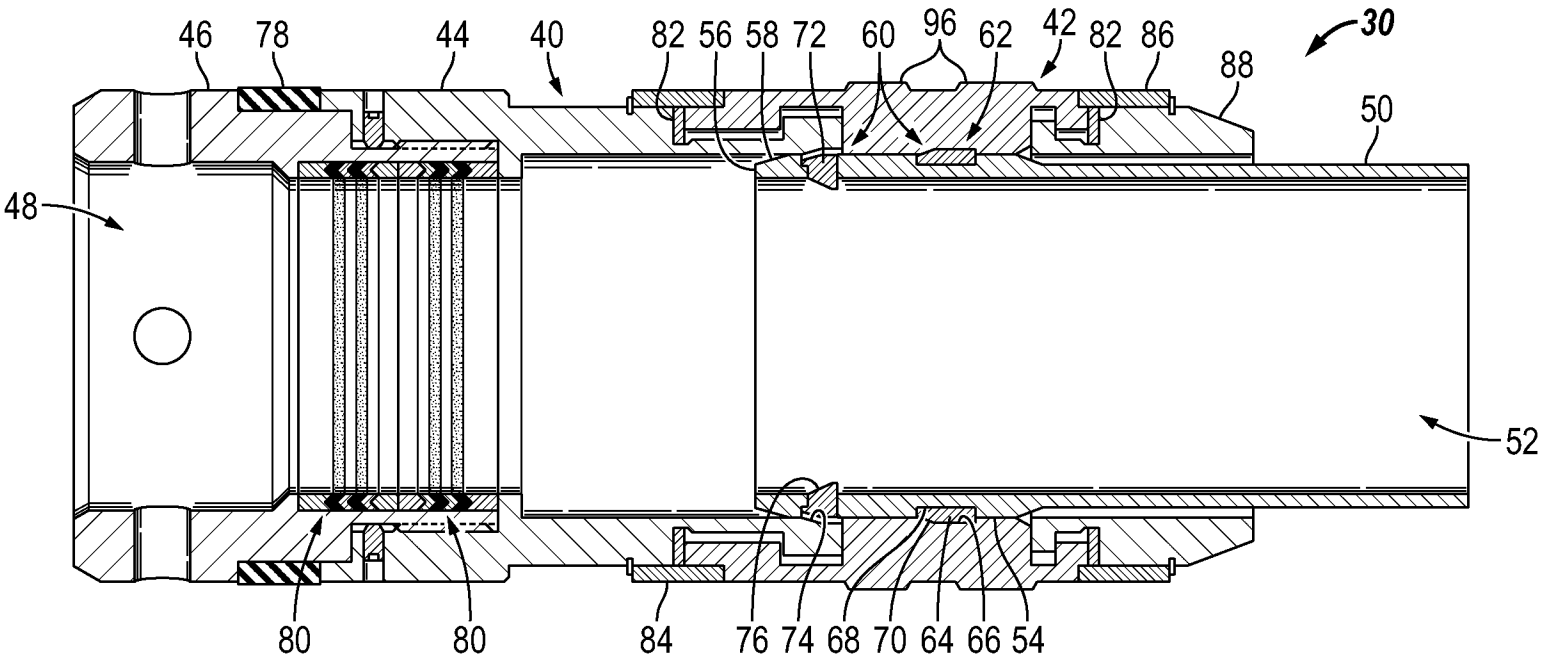
FIG. 2 is a cross-sectional view of an example of the retrievable cement bushing, according to an embodiment of the disclosure.

Referring generally to FIG. 2, an example of the retrievable cement bushing 30 is illustrated. In this example, the retrievable cement bushing 30 comprises a body 40 to which an engagement lug 42 is movably mounted. The engagement lug 42 may be an individual engagement lug or a plurality of engagement lugs. In the specific embodiment illustrated, the engagement lug 42 comprises a plurality of engagement lugs 42 which are circumferentially mounted around the body 40. The engagement lug or lugs 42 may be mounted for radial movement which is movement between a radially inward or retracted position and a radially outward or expanded position. However, the movement of the engagement lug or lugs 42 between the radially inward position and the radially outward position may be movement along a straight, angular, curved, or other suitable path depending on the structure of body 34 and engagement lug 42.

In the example illustrated in FIG. 2, the plurality of engagement lugs 42 is movably mounted on a center body portion 44 of body 40. The center body portion 44 is constructed to guide the engagement lugs 42 as the engagement lugs 42 transition between their radially inward and radially outward positions. In some applications, body 40 also may comprise other components including a top adapter 46. Furthermore, body 40 comprises an internal longitudinal passage 48 extending therethrough.

The retrievable cement bushing 30 also comprises a sleeve 50 slidably mounted within body 40 for longitudinal movement along internal longitudinal passage 48. The sleeve 50 has a hollow interior 52 generally aligned with and extending internal longitudinal passage 48 through the retrievable cement bushing 30. The sleeve 50 is movable in a longitudinal direction to a radially inward position relative to the engagement lug or lugs 42. Once moved to the radially inward position, the sleeve 50 holds the engagement lug or lugs 42 in a radially outward position for engagement with wall 32.

In the example illustrated, sleeve 50 further comprises a radially expanded portion 54 located to act against the engagement lugs 42 when the sleeve 50 is moved to the radially inward position illustrated in FIG. 2. The radially expanded portion 54 also may comprise a lead end 56 having a sloped surface 58. The sloped surface 58 is oriented to facilitate transition of the engagement lugs 42 from a radially inward position to a radially outward position as the sleeve 50 is moved in a longitudinal direction to the illustrated radially inward position relative to engagement lugs 42. In many applications, movement of the sleeve 50 from a non-actuated position (engagement lugs 42 radially inward) to an actuated position (engagement lugs 42 radially outward) involves longitudinal movement of the sleeve 50 relative to body 40 in an upward or uphole direction from a lead or bottom end of the retrievable cement bushing 30.

As illustrated, the retrievable cement bushing 30 also may comprise a retention member 60 which releasably secures the sleeve 50 at the radially inward position relative to engagement lugs 42. The retention member 60 may comprise an individual member or a plurality of members. For example, the retention member 60 may comprise a retainer 62 positioned between sleeve 50 and the at least one engagement lug 42. In the example illustrated, the retainer 62 comprises a C-ring 64 captured between an internal feature 66 of the engagement lugs 42 and an external feature 68 of the sleeve 50 to releasably secure the sleeve 50 to the engagement lugs 42. The retainer 62 may comprise a chamfered or otherwise sloped lead surface 70 oriented to facilitate further longitudinal movement of sleeve 50 into body 40 so as to shift the radially expanded portion 54 from beneath engagement lugs 42 and to thus release the retrievable cement bushing 30 from the surrounding wall 32 when the retrievable cement bushing 30 is to be retrieved uphole.

The retention member 60 also may comprise at least one locking lug 72 positioned to selectively lock the sleeve 50 at the radially inward position relative to the engagement lugs 42. In the illustrated example, a plurality of the locking lugs 72 is mounted to sleeve 50. By way of example, the locking lug or lugs 72 may be pivotably mounted to sleeve 50 for pivotable movement in a radially outward direction to a locked position, as illustrated in FIG. 2. In the locked position, each locking lug 72 engages an abutment surface 74 of the corresponding engagement lug 42 to secure the sleeve 50 and to thus lock the engagement lugs 42 in the radially outward position. Each locking lug 72 also may comprise a sloped or otherwise configured surface 76 oriented to facilitate transition of the locking lug 72 from an unlocked to a locked position, as explained in greater detail below.

The retrievable cement bushing 30 also may comprise a variety of other features. For example, the retrievable cement bushing 30 may comprise an external seal or seals 78 positioned on the body 40 to form a seal between body 40 and the surrounding wall 32. The retrievable cement bushing 30 also may comprise an internal seal or seals 80 mounted in the body 50 along the internal longitudinal passage 48. The internal seal or seals 80 may be designed to form a seal between the retrievable cement bushing 30 and an internal slick joint slidably received along internal longitudinal passage 48, as described in greater detail below. The external and internal seals 78, 80 may be positioned at a variety of locations along body 40 and/or at other suitable locations along retrievable cement bushing 30.

The retrievable cement bushing 30 also may comprise other components, such as components to guide the engagement lugs 42 during translation between the radially inward and radially outward positions. For example, a sliding feature 82, e.g. a plurality of slide pins, may be positioned at longitudinal ends of the engagement lug or lugs 42. The engagement lugs 42 also may be retained by a top retainer ring 84 and a bottom retainer ring 86. The retainer rings 84, 86 secure the sliding features 82 in a manner which facilitates sliding radial movement of the engagement lug or lugs 42. In the example illustrated, the bottom retainer ring 86 may be secured in place by a nose member 88. The nose member 88 also may have features which guide the radial movement of the engagement lugs 42 as they are moved between the radially inward and outward positions. A variety of fasteners, e.g. set screws, may be used to secure the bushing components when constructing retrievable cement bushing 30. For example, set screws or other fasteners may be used to secure center body portion 44 with top adapter 46, top retainer ring 84 with center body portion 44, and bottom retainer ring 86 with nose member 88.

Figure 3:
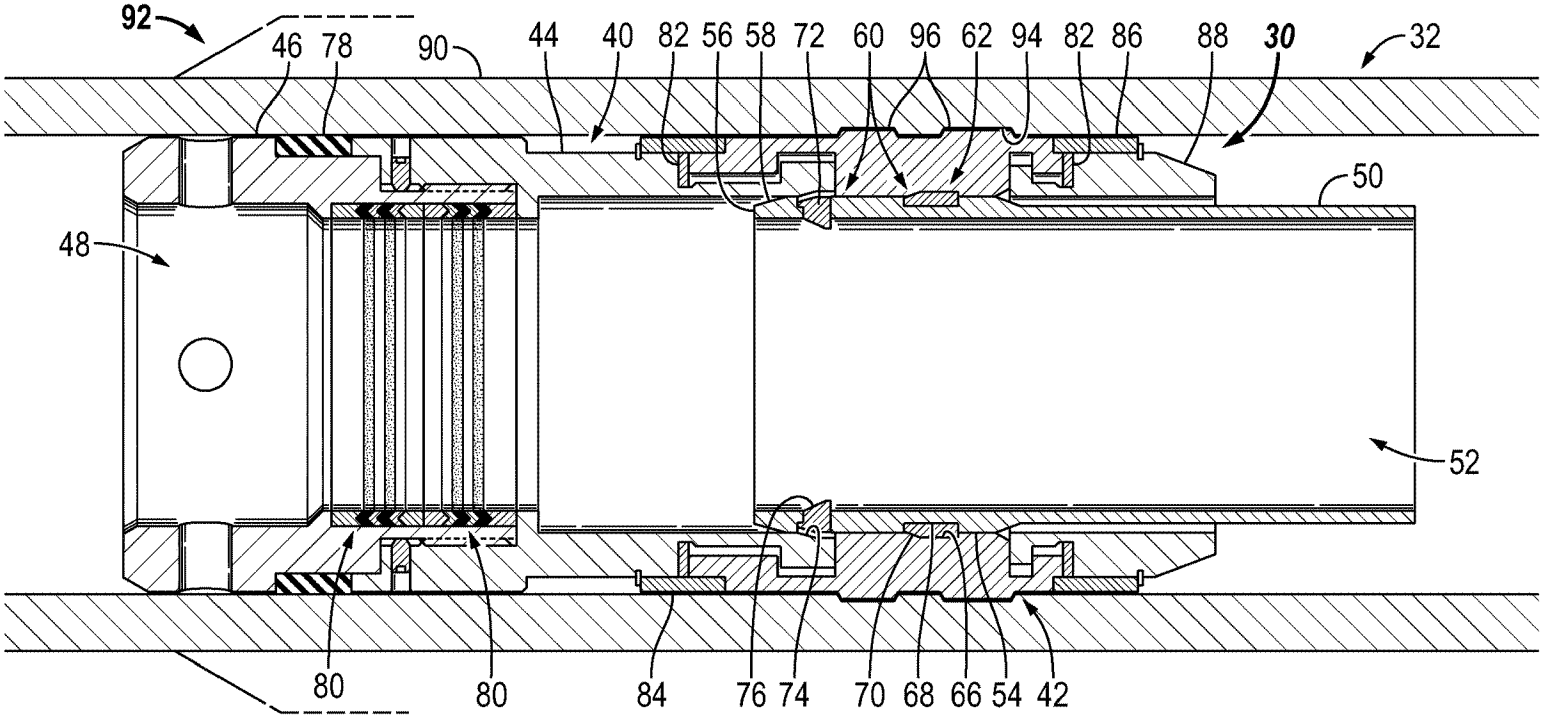
FIG. 3 is a cross-sectional view of an example of the retrievable cement bushing disposed in a surrounding well tubular, such as a surrounding packer body, according to an embodiment of the disclosure.

With additional reference to FIG. 3, the retrievable cement bushing 30 is illustrated as engaged with the surrounding wall 32. In this example, the surrounding wall 32 comprises a wall of a packer body 90 which forms part of a packer 92 of the surrounding tubular system 24. As illustrated, the wall 32 comprises a radially inward engagement feature 94 having a profile selected to latch with a radially outward engagement feature 96 disposed along the radially outer surface of the engagement lug or lugs 42. In other words, the engagement feature 96 of engagement lugs 42 moves into engagement with the corresponding engagement feature 94 of wall 32/packer 92 to latch the retrievable cement bushing 30 at the desired location with respect to the surrounding wall 32 of tubular system 24.

For example, the retrievable cement bushing 30 may be moved via tool string 22 into position within surrounding wall 32. The sleeve 50 is then shifted longitudinally to the radially inward position relative to the surrounding engagement lugs 42. For example, the sleeve 50 may be pushed into the body 40 from a bottom end so that the leading edge surface 58 of the sleeve 50 pushes the engagement lugs 42 outwardly to the illustrated, radially outward position in which engagement features 96 latch into corresponding engagement features 94 of wall 32. (The sleeve 50 may be shifted by a slick joint having an appropriate tool or by another suitable tool.) As the sleeve 50 is shifted longitudinally, retainer 62, e.g. C-ring 64, collapses and moves longitudinally until captured in position between the internal feature 66 of the engagement lugs 42 and the external feature 68 of sleeve 50. The retainer 62 may be used to lock the sleeve 50 with respect to the body 40 of the retrievable cement bushing 30 in one direction.

Figure 4:
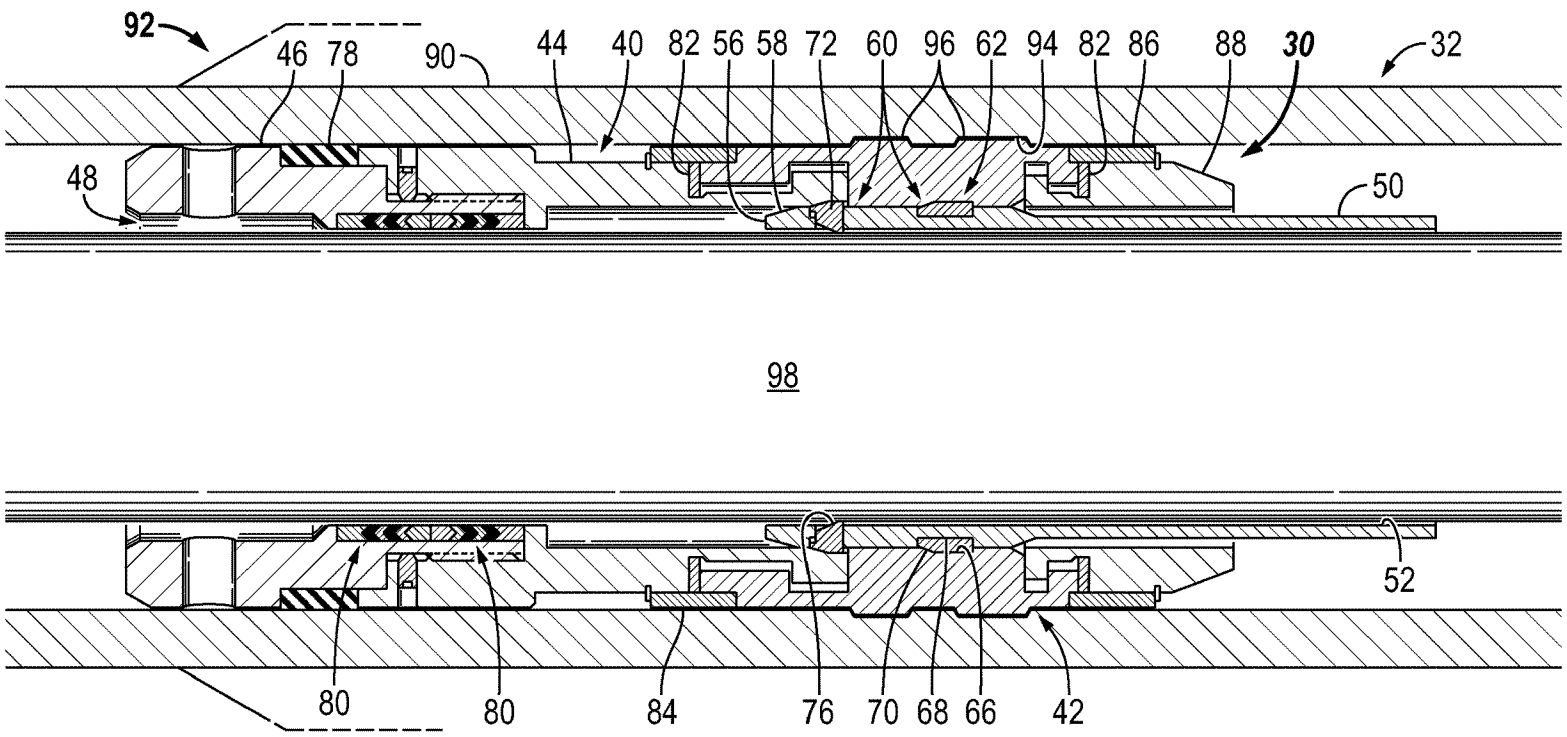
FIG. 4 is a cross-sectional view of an example of the retrievable cement bushing disposed in a surrounding well tubular and having a slick joint extending therethrough, according to an embodiment of the disclosure.

At this stage, a slick joint 98 can be installed through a top end of the retrievable cement bushing 30 and moved longitudinally through the retrievable cement bushing 30 along internal longitudinal passage 48, as illustrated in FIG. 4. The slick joint 98 is sized and the engagement surfaces 76 of locking lugs 72 are oriented so that the slick joint 98 contacts surfaces 76 and forces the locking lugs 72 to pivot radially outwardly when the slick joint 98 is initially moved through retrievable cement bushing 30 along internal longitudinal passage 48. The retainer 62 effectively blocks movement of the sleeve 50 from the radially inward position while the slick joint 98 is being assembled.

Once the locking lugs 72 are shifted radially outward to their locking position, they work with retainer 62 to lock the sleeve 50 against movement in both directions. At this stage, the retrievable cement bushing 30 is locked in position within surrounding wall 32 and sleeve 50 is similarly locked in position within body 40 to allow movement of the slick joint 98 up-and-down through the sleeve 50 and through the overall retrievable cement bushing 30. The sleeve 50 blocks radially inward movement of engagement lugs 42 and thus prevents premature release of the retrievable cement bushing 26. The sleeve 50 also protects the slick joint 98 from loading by the engagement lugs 42 during longitudinal movement of the slick joint through the retrievable cement bushing 30.

The well system 20 may be formed with a wide variety of components for use in many types of environments and applications. For example, well system 20 may comprise a variety of tubing strings, completion components, well servicing devices, and/or other components depending on the parameters of a given environment and application. The well system 20 also may be used in a variety of wells, including vertical wells, deviated wells, and multilateral wells.

Similarly, the retrievable cement bushing 30 may utilize many types of components in various configurations and constructed from many types of materials. For example, the structure of the body and engagement lug or lugs may vary. Similarly, the seal systems may vary in structure, positioning, seal number, and arrangement. The engagement features and locking features on the sleeve, engagement lugs, and/or surrounding wall structure also may be designed according to the application, environment, and component arrangement. Additionally, the size, construction, and arrangement of many of the components can be selected based on numerous environmental parameters and other parameters of a given application.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for containing pressure in a well, comprising:

a retrievable cement bushing comprising:

a body having an internal longitudinal passage therethrough;

an engagement lug mounted on the body, the engagement lug being movable in a radially outward direction and having an outer engagement feature oriented to engage a corresponding feature in a surrounding wall;

a sleeve having a hollow interior sized to receive a slick joint, the sleeve being movable in a longitudinal direction to a radially inward position relative to the engagement lug, the sleeve having a radially expanded portion with a sloped region positioned to shift to the engagement lug radially outward so the radially expanded portion is able to hold the engagement lug in a radially outward position when the sleeve is located at the radially inward position; and a retention member that releasably secures the sleeve at the radially inward position relative to the engagement lug, the retention member comprising: a retainer; and at least one locking lug pivotably mounted to the sleeve.

2. The system as recited in claim 1, wherein the engagement lug comprises a plurality of engagement lugs circumferentially disposed about the body.

3. The system as recited in claim 1, further comprising an external seal mounted on the body.

4. The system as recited in claim 1, further comprising an internal seal mounted on the body.

5. The system as recited in claim 1, wherein the retainer comprises a C-ring captured between an internal feature of the engagement lug and an external feature of the sleeve to secure the sleeve to the engagement lug.

6. The system as recited in claim 1, wherein the at least one locking lug has a sloped surface oriented for engagement with the slick joint such that movement of the slick joint through the internal longitudinal passage forces the at least one locking lug radially outward to a locking position.

7. A system, comprising:

a retrievable cement bushing comprising:

a body having an internal longitudinal passage therethrough;

an engagement lug movably mounted to the body;

a sleeve movable in a longitudinal direction along the internal longitudinal passage to transition the engagement lug to an outward position;

a retention member mounted on the sleeve and positioned to secure the sleeve with respect to the engagement lug so as to hold the sleeve at a location which maintains the engagement lug in the outward position; and an external seal and an internal seal disposed along the body, wherein the retention member comprises: a ring positioned between the sleeve and the engagement lug; and a locking lug pivotably mounted on the sleeve.

8. The system as recited in claim 7, wherein the at least one locking lug comprises an engagement surface oriented for engagement with a slick joint.

9. The system as recited in claim 7, wherein the retrievable cement bushing is mounted in a tool string.

* * * * *